US005533249A

United States Patent [19]

Wakeman

[11] Patent Number: 5,533,249

[45] Date of Patent: Jul. 9, 1996

[54] METHOD OF MAKING A TWO PIECE STATOR WITH MAGNETIC BOBBIN

[75] Inventor: Russell J. Wakeman, Canton, Mich.

[73] Assignee: Siemens Automotive Corporation, Auburn Hills, Mich.

[21] Appl. No.: 430,020

[22] Filed: Apr. 27, 1995

[51] Int. Cl.[6] ..... H01F 41/02

[52] U.S. Cl. ..... 29/605; 29/602.1; 239/585.1; 251/129.15; 336/208

[58] Field of Search ..... 29/605, 602.1, 29/606; 239/585.1; 251/129.15, 129.21; 336/296–298; 335/208

[56] References Cited

U.S. PATENT DOCUMENTS 5,289,627 3/1994 Cerny et al. ..... 29/602.1

5,428,883 7/1995 Stieglitz ..... 29/602.1

*Primary Examiner*—Carl E. Hall

*Attorney, Agent, or Firm*—Russel C. Wells

[57] ABSTRACT

A method of making a solenoid coil assembly comprises the steps of providing a bobbin made of an insulated magnetic material. A pair of electrical terminals is mounted on the bobbin for connection with a separable electrical connector. A two-piece stator assembly is comprised of an inner pole disposed on the interior of the bobbin and an outer pole disposed on the exterior of the bobbin. The bobbin is then molded over the inner pole core. The insulated magnetic material of the bobbin comprises a plurality of magnetic granules, each of the plurality of magnetic granules being coated with a layer of insulating material, thereby preventing an electrical path from granule to granule.

7 Claims, 1 Drawing Sheet

METHOD OF MAKING A TWO PIECE STATOR WITH MAGNETIC BOBBIN

FIELD OF THE INVENTION

This invention relates in general to solenoid operated or electromagnetically operated valves of the type that are used to inject liquid fuel into the induction system of an internal combustion engine, and more particularly to a two-piece stator with a magnetic bobbin, for use in such valves.

BACKGROUND OF THE INVENTION

In a compact dual gap solenoid design, packaging of the solenoid windings is difficult because of the requirement for cross-sectional area in the magnetic circuit. For a given package size and a given force level, the pole areas (inner and outer) determine the space remaining between the poles for windings and whatever structure is required to support them. This support structure usually takes the form of a molded bobbin, made of a non-conductive, and usually non-magnetic, material. Unfortunately, the material of the bobbin does not contribute to the cross-section of the magnetic circuit, and it displaces volume which would otherwise contribute to the number of turns of wire in the coil.

Previous attempts to make use of the space taken up by the bobbin, such as free-standing coils, metallic bobbins, and metal-filled plastic bobbins, have had limited success. This is because of the difficulty in meeting the requirement for very good insulation in order to maintain the electrical integrity of the coil, particularly when the terminals are molded into the bobbin.

From commonly assigned U.S. Pat. No. 5,065,128, it is known to injection-mold encapsulating material around an electromagnetic coil, thereby creating an encapsulated coil, and then to use the encapsulated coil in the solenoid of a solenoid-actuated valve, such as in U.S. Pat. Nos. 5,083,747 and 5,102,095, also commonly assigned.

From commonly assigned U.S. Pat. No. 5,226,221, it is known to support an electromagnetic coil on a holder that contains electrical terminals to which terminations of the coil have been attached, to injection-mold encapsulating material around the coil and holder except for distal end portions of the electrical terminals, thereby creating an encapsulated coil, and then to use the encapsulated coil in a solenoid.

Attempts to use plastic bobbins with ferrous material as filler have been largely unsuccessful because they contain a significant amount of conductivity which short circuits the coil. Using the bobbin as part of the magnetic circuit will only be successful if a solution is found for insulating the wires and terminals from the magnetic material.

It is seen then that there exists a need for an improved means of packaging the solenoid windings which overcomes the problems encountered in the prior art.

SUMMARY OF THE INVENTION

This need is met by the present invention, which uses a commercially available material composed of granulated magnetic material, with each granule individually coated with a layer of insulator. In this way, there is no electrical path from granule to granule.

In accordance with one aspect of the present invention, a method of making a solenoid coil assembly comprises the step of providing a bobbin made of an insulated magnetic material. A pair of electrical terminals is mounted on the bobbin for connection with a separable electrical connector. A two-piece stator assembly is comprised of an inner pole disposed on the interior of the bobbin and an outer pole disposed on the exterior of the bobbin. The bobbin is then mounted or molded over the inner pole core. The insulated magnetic material of the bobbin comprises a plurality of magnetic granules, each of the plurality of magnetic granules being coated with a layer of insulating material, thereby preventing an electrical path from granule to granule.

Further features, advantages, and benefits of the invention will be seen in the ensuing description and claims which should be considered in conjunction with the accompanying drawing. This drawing illustrates a presently preferred embodiment of the invention according to the best mode contemplated at this time for carrying out the invention.

BRIEF DESCRIPTION OF THE DRAWING

The drawing is a cross section view of a solenoid valve according to the present invention.

DESCRIPTION OF THE PREFERRED EMBODIMENT

Figure 1:
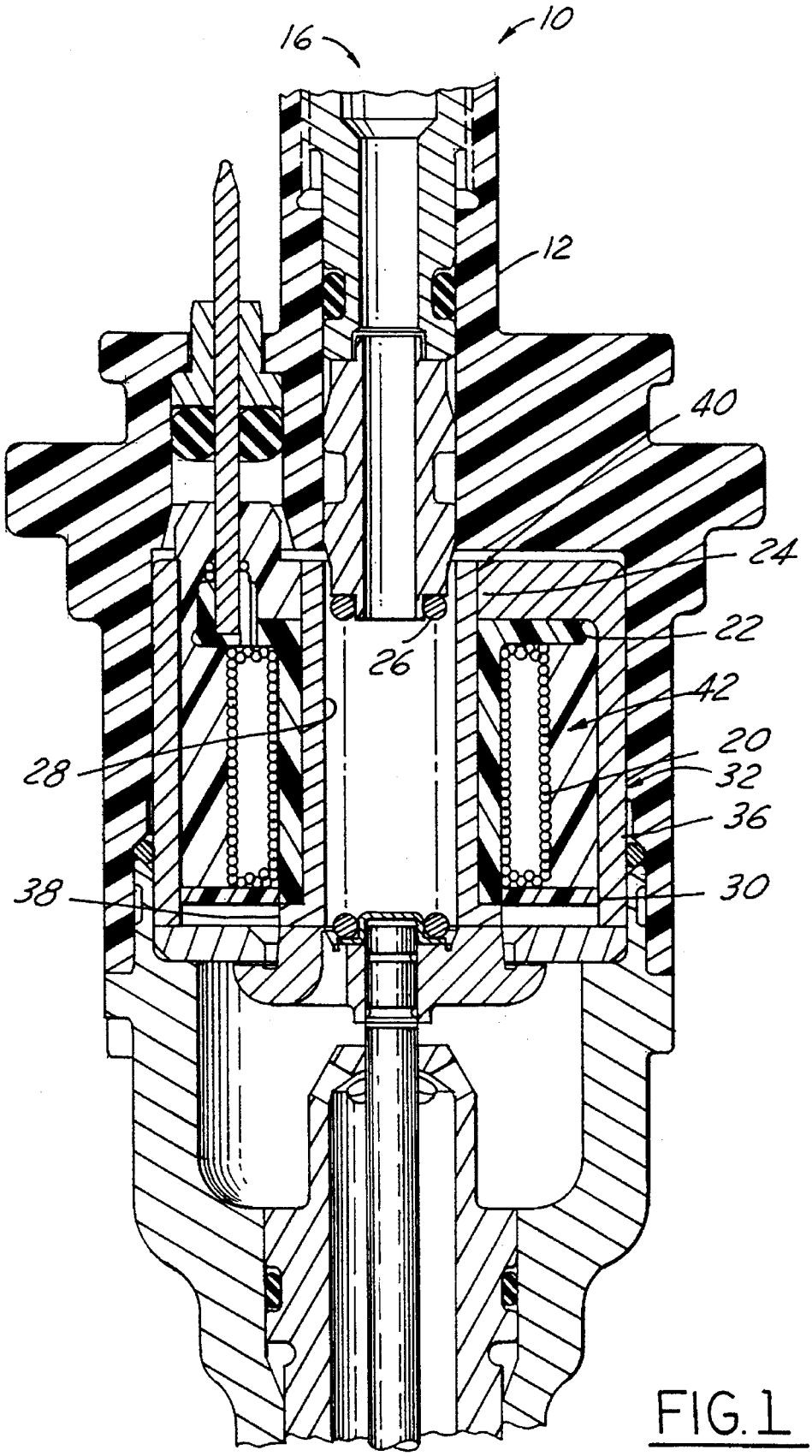

In the present invention, a commercially available material, such as SMP 1171, a material developed by Siemens VacuumSchmelze, and licensed to Sintermetalle Prometheus, is used as the bobbin. The material is composed of granulated magnetic material, with each granule individually coated with a layer of insulator. In this way, there is no electrical path from granule to granule, and the magnetic properties are nearly that of the parent (i.e., uncoated magnetic) material, reduced only by the density change caused by the introduction of the insulating (coating) material. The magnetic insulated material is processed into near-net shapes by compression molding, which leaves the insulating coating intact between each magnetic domain and neighboring domains.

Referring now to the drawing, there is illustrated in cross section, a typical solenoid valve 10 comprising a substantially tubular housing structure 12 having an axially extending tubular passageway and an associated valve body portion 14. The housing 12 has an open end 16 and the valve 10 further includes a valve opening end 18 for receiving a reciprocating needle valve for closing the injector.

In accordance with the present invention, a coil 20 is comprised of a magnetic bobbin 22 having an "L" shaped cross section with the foot of the "L" providing means for connecting the ends of the wire of the layered coil to terminals. The insulated magnetic material of the present invention is used as the bobbin for the solenoid windings, incorporating the bobbin and, consequently, the space taken up by the bobbin, into the magnetic circuit. Since the bobbin space is now implemented as part of the magnetic circuit, a compact injector can now produce more powerful results in the same size package than previously available. Since, for a given package size and a given force level, the pole areas (inner and outer) determine the space remaining between the poles for windings and whatever structure is required to support them, the form factor for the coil is also improved. With the present invention, the form factor becomes wider, as a result of the reduced I. D., and shorter, as a result of a flange 38 at the end of an inner pole 24, thereby reducing the fringing losses that go with a long slender coil. A spring 26 is slidably received in a bore 28 in the inner pole 24 of the solenoid core.

One of the factors limiting the speed of the solenoid 10 is eddy currents generated in ferromagnetic materials of the valve. Since the magnetic path, incorporating the bobbin 22, is made of high-resistivity material, the eddy currents in this part of the circuit are virtually nonexistent, providing the advantages of increasing the speed of the magnetic circuit and reducing the eddy current losses. An associated washer 30 is connected to the end of the bobbin opposite the foot end providing structural integrity. The washer 30 extends from the bobbin to the outer pole and is preferably non-magnetic, non-conductive material such as a nylon-type material.

A stator 32 of the solenoid 10 operates armature 34. The stator 32, which has previously been made as a one-piece component, is made as an assembly in accordance with the present invention. The stator 32 of the present invention comprises a cup-shaped outer pole 36, with inner pole 24 as a separate piece which would be assembled with the outer pole.

The force requirement of the solenoid implies, with a given level of magnetic saturation, a particular cross section in the magnetic circuit poles. The pole area of the inner part of the stator is then left at its conventional diameters, and the remainder of the length of the inner part of the stator is undercut forming a flange 38 to support the magnetic plastic bobbin material. The strength of the magnetic plastic and its hardness are relatively poor, so the conventional magnetic steel is left in the area which is an impact face which is the flange 38. The bobbin 22 is then mounted or molded over the inner pole core. In a preferred embodiment of the present invention, this is accomplished in such a way that the cross section of the magnetic steel plus the cross section of the magnetic plastic are equal to the area at the poles. In this way, the magnetic force is not compromised by magnetic saturation in a reduced area of the circuit. Further, in a preferred embodiment, the magnetic plastic is molded so as to leave no gaps at an inner pole flange 38 or at a web at the back of the outer pole cup 36.

In accordance with one embodiment of the present invention, a flange is provided at either end of the bobbin. Alternatively, self-adhesive wire is used to make a free-standing coil over the magnetic plastic spool. At joint 40 of the inner and outer pole this can be a magnetic flange, and if it is recessed into the web of the outer stator cup, it can provide a fast, low loss part of the magnetic circuit in a similar manner as the material in the inner pole. The bobbin washer 30 at the pole end of the inner stator must be non-magnetic and non-conductive, since the outer diameter of this washer 30 extends to the outer pole 32. If the material was magnetic, fringing from this washer to the outer pole would cost much of the magnetic force. This washer is secured to the bobbin by appropriate means since both the material of the bobbin and the washer are similar, if not identical The bobbin 22, after being inserted or molded over the inner pole core, is wound and terminated as an assembly with the inner pole core, just as with a conventional bobbin, it is then assembled into the outer pole cup 36 as a unit. The joint 40 between the magnetic steel inner pole and the magnetic steel cup is a press fit to insure that there is no magnetic gap in the joint to cost force. The inner pole 24 is pressed until the magnetic plastic makes good contact with the web of the outer pole cup and the flange 28 to insure that no gap exists and either joint. An appropriate joining method, such as welding, crimping, swaging, etc., can be used to insure that the joints are structurally reliable, and the poles can be finished as in a conventional one-piece stator. Once the bobbin and the pole assembly are completed, a non-magnetic, non-conductive overmold or encapsulating material 42 is used to fill all the open spaces between the outer pole and the bobbin and to give the terminal area of the bobbin structural integrity.

Another advantage the design according to the present invention is the reduced stiffness of the inner pole 24, which also serves as the stop for the armature 34. Injectors suffer reduced linearity performance when the armature bounces, on opening, as it strikes its stop. Preferably, the armature's kinetic energy is absorbed elastically and dissipated in the material of the stop, preventing such a bounce. One method which has been shown to be effective is to reduce the cross section of the stop until its spring rate is relatively low, at which point it can flex as the armature strikes it. With the inner pole undercut in accordance with the present invention, the stop is a cantilevered flange, backed with very soft magnetic plastic. While the plastic is comparable to steel magnetically, mechanically it is more like the polymer that is used to insulate the magnetic granules, and contributes little to the stiffness of the flange. This allows the flange to be relatively flexible without giving up magnetic force or pole area.

While a presently preferred embodiment of the invention has been illustrated and described, it should be appreciated that principles are applicable to other embodiments without departing from the scope of the invention defined in the appended claims.

What is claimed is:

1. A method of making a solenoid coil assembly comprising the steps of:

providing a bobbin having an essentially "L" shaped cross section;

mounting to the foot of the "L" shaped bobbin a pair of electrical terminals for connection with a separable electrical connector;

securing a washer member to the opposite end of the bobbin;

providing an inner pole disposed on the interior of said bobbin, said inner pole having a core and a flange;

mounting said bobbin over the inner pole core and in contact with the flange of the inner pole;

winding a plurality of layers of insulated coils fabricated from a continuous wire around said bobbin; and then disposing an outer pole on the exterior of said bobbin such that it cooperates with the inner pole to form a stator assembly.

2. A method of making a solenoid coil assembly as claimed in claim 1 wherein said bobbin comprises an insulated magnetic material.

3. A method of making a solenoid coil assembly as claimed in claim 2 wherein said insulated magnetic material comprises a plurality of magnetic granules.

4. A method of making a solenoid coil assembly as claimed in claim 3 further comprising the step of preventing an electrical path from granule to granule.

5. A method of making a solenoid coil assembly as claimed in claim 4 wherein the step of preventing an electrical path from granule to granule comprises the step of coating each of the plurality of magnetic granules with a layer of insulating material.

6. A method of making a solenoid coil assembly as claimed in claim 1 further comprising the step providing an overmold between the bobbin and the outer pole member.

7. A method of making a solenoid coil assembly as claimed in claim 1 wherein said outer pole is cup shaped.

* * * * *